US006218624B1

(12) United States Patent
Hanssen et al.

(10) Patent No.: US 6,218,624 B1
(45) Date of Patent: Apr. 17, 2001

(54) COAXIAL CABLE

(75) Inventors: Hans Hanssen, Erlecom; Hans de Boer, Endhoven; Jos van Oorschot, Veldhoven, all of (NL)

(73) Assignee: Belden Wire & Cable Company, Richmond, IN (US)

( * ) Notice: Subject to any disclaimer, the term of this patent is extended or adjusted under 35 U.S.C. 154(b) by 762 days.

(21) Appl. No.: 08/495,330

(22) Filed: Jun. 27, 1995

(30) Foreign Application Priority Data

Jul. 5, 1994 (EP) ..... 94201928

(51) Int. Cl.[7] ..... H01B 5/14
(52) U.S. Cl. ..... 174/126.4; 174/36
(58) Field of Search ..... 174/126.4, 36, 174/126.2, 102 R

(56) References Cited

U.S. PATENT DOCUMENTS

| | | | | |
|---|---|---|---|---|
| 3,569,611 | * | 3/1971 | Berends | 174/107 X |
| 3,576,387 | | 4/1971 | Derby | 174/36 |
| 4,079,503 | * | 3/1978 | Schnabel | 29/570 X |
| 4,096,350 | * | 6/1978 | Mayr et al. | 174/88 C X |
| 4,186,237 | * | 1/1980 | Propp | 428/323 |
| 4,199,408 | * | 4/1980 | Sherman | 204/15 X |
| 4,440,823 | * | 4/1984 | Hoffmann | 428/209 X |
| 4,847,448 | * | 7/1989 | Sato | 174/103 X |
| 4,987,274 | * | 1/1991 | Miller et al. | 174/102 R |
| 5,171,937 | | 12/1992 | Aldissi | 174/36 |
| 5,252,984 | * | 10/1993 | Dorrie et al. | 343/715 X |
| 5,397,855 | | 3/1995 | Ferlier | 174/36 |

FOREIGN PATENT DOCUMENTS

| | | |
|---|---|---|
| 0384505 | 8/1990 | (DE) . |
| 2 437 250 | 4/1980 | (FR) . |
| 2 484 688 | 12/1981 | (FR) . |
| WO 94/16624 | 4/1994 | (WO) . |

* cited by examiner

*Primary Examiner*—Kristine Kincaid
*Assistant Examiner*—Chau N. Nguyen
(74) *Attorney, Agent, or Firm*—Robert E. I. Conte; Lee, Mann, Smith, McWilliams, Sweeney & Ohlson

(57) ABSTRACT

The invention relates to a coaxial cable as well as to the manufacture of such a cable. The cable has a central conductor and an outer conductor which are separated from each other by an electrically insulating layer the outer conductor being provided, if necessary, with at least a protective coating. In accordance with the invention, the outer conductor of the cable has an electroconductive lacquer layer. In accordance with a preferred embodiment, a metal layer is applied to the lacquer layer. The cables in accordance with the invention can be manufactured much more rapidly than the known cables which have a stranded outer conductor or an outer conductor of metal foil. This advantage occurs in particular in the manufacture of very thin coaxial cables. In addition, the cables in accordance with the invention exhibit a satisfactory electromagnetic shielding.

12 Claims, 1 Drawing Sheet

COAXIAL CABLE

FIELD OF THE INVENTION

The invention relates to a coaxial cable comprising a central conductor and an outer conductor which are separated from each other by an electrically insulating layer, said outer conductor being provided, if necessary, with at least a protective coating. The invention also relates to a method of manufacturing a coaxial cable having this structure.

BACKGROUND

Coaxial cables are known per se, for example, from U.S. Pat. No. 4,368,576, filed by Applicants. The known coaxial cables usually comprise an elongated, central conductor of metal which is concentrically situated in an elongated, tubular outer conductor of metal. Said central conductor is usually composed of a solid copper wire which is circular in section. Copper-clad wires of aluminum or steel are also known to be used for this purpose. Central conductors composed of a bundle of stranded or wound wires, so-called litzes, are also known.

The outer conductor of a coaxial cable is often composed of a layer of fine, stranded or wound metal wires or a wound metal foil. Aluminum or copper, which latter material may be tin-plated or not, is usually used as the material for these wires and foils. An important property of stranded outer conductors is that they provide the coaxial cable with a high degree of flexibility.

The central conductor and the outer conductor are generally separated from each other by a layer of an electrically insulating material, preferably a solid or foamed synthetic material. Coaxial cables in which air is used as the electrically insulating material between the conductors (so-called "semi-air spaced cables") are also known.

If necessary, one or more additional protective coatings of an electrically insulating material, preferably a synthetic resin, can be provided on the outer conductor. Dependent upon the usage of the coaxial cable, these coatings are provided with reinforcing elements, for example in the form of wires of metal or synthetic resin which are wound in the same direction. The presence of such protective coatings, however, is not absolutely necessary. For example, it is known to use bundles of coaxial cables without a protective coating in transmission cables of ultrasound equipment.

The known coaxial cable has disadvantages. It has been found that when this type of cable is miniaturized, the provision of the outer conductor becomes problematic. This applies both to a stranded outer conductor and to an outer conductor of metal foil. For example, the metal wires used for a stranded outer conductor must have a minimum thickness. The use of wire thicknesses below 25 micrometers results in an unsatisfactory stranding process. In addition, also when larger wire thicknesses are used, the stranding process proceeds very slowly. When relatively thin coaxial cables with a stranded or wound outer conductor are used, the rates typically are of the order of 10–30 cm per minute. Also, when coaxial cables comprising an outer conductor which is made of a foil are miniaturized, production-technical problems occur when the foil is provided. In practice it has been found that it is impossible to wind the foil when the diameter of the cables is less than 1.5 mm. However, when thicker cables are used, the provision process is very laborious and time-consuming.

SUMMARY

It is an object of the invention to provide a coaxial cable which does not have the above-mentioned disadvantages.

The invention more particularly aims at a coaxial cable having a relatively thin outer conductor. The inventive cable should also exhibit a relatively high electromagnetic shielding. The coaxial cable in accordance with the invention must further be reliable and its manufacture should be simple and take little time. This relates, in particular, to the rate of providing the outer conductor on the electrically insulating layer.

These and other objects are achieved by means of a coaxial cable of the type mentioned in the opening paragraph, which is characterized according to the invention in that the outer conductor comprises an electroconductive lacquer layer.

It has been found that such electroconductive lacquers can be provided in very thin layers. Layer thicknesses below 200 micrometers, even below 100 micrometers, can be provided on an electrically insulating layer without any problem. Consequently, the invention enables relatively thin coaxial cables to be manufactured. Such thin coaxial cables can be very successfully used as connection wire in ICs. Experiments leading to the invention have shown that electroconductive lacquer layers having a thickness in the range from 5–30 micrometers are still satisfactory. It is noted that the expression "electroconductive lacquer layer" is to be understood to mean herein a layer comprising electroconductive particles which are embedded in a polymeric matrix. An example of such a layer is a lacquer layer comprising electroconductive soot particles in a thermoplastic resin.

Surprisingly, it has been found that such electrocondcutive lacquers are sufficiently elastic to preclude the formation of detrimental hair cracks in the outer conductor upon bending of the coaxial cable. This applies in particular when the thickness of the lacquer layer is below 50 micrometers. It has been found that these lacquers adhere to a large number of insulating synthetic resins, such as polyolefins, foamed or non-foamed polyethylene, polypropylene or mixtures thereof, and also on polyvinyl chloride (PVC) and fluorine-containing polymers. By virtue of the uniform structure of the outer conductor thus provided, the electromagnetic shielding of the inventive cable is better than that of cables provided with stranded outer conductors. It is further noted that the lacquer layers can be rapidly applied in a simple manner. Application rates of many tens of meters per minute can be realized without any problem. Thus, the rate of application is much higher than in the case of stranded outer conductors or outer conductors of wound metal foil.

A preferred embodiment of the coaxial cable is characterized in accordance with the invention in that the lacquer layer comprises electroconductive particles of metal, preferably silver or copper. Electroconductive lacquer layers comprising metal particles exhibit a relatively high conductivity. This applies in particular to silver or copper particles. If the outer conductor of the inventive cable must exhibit a specific conductivity, the use of conductive lacquers on the basis of metal particles allows a thinner layer to be applied than when a lacquer on the basis of conductive soot particles would be used. The exact quantity of conductive particles in the lacquer, the resin to be used, the exact layer thickness, the exact conductivity of the lacquer layer etc. can be routinely determined by those skilled in the art.

A very suitable embodiment of the coaxial cable is characterized in accordance with the invention in that a thin metal layer is present on the electroconductive lacquer layer. This embodiment is particularly suitable for those inventive coaxial cables whose electroconductive lacquer layer exhibits too low of an electric conductivity for a specific application. In addition, this measure results in a further improvement of the electromagnetic shielding of the cable.

The metal layer can be applied in various ways, for example, by means of vacuum deposition or sputtering. However, the outer metal layer is preferably provided in an electrochemical process, for example electroless nickel-plating, or from a metal bath, for example by hot tinning. For reasons relating to costs and production-technical aspects, the metal layer can most suitably be applied by means of electrodeposition.

The invention also relates to a method of manufacturing a coaxial cable. This method is characterized in accordance with the invention in that a central conductor which is provided with an electrically insulating layer, is passed through a solution of an electroconductive lacquer, whereafter the cable is dried and, if necessary, said lacquer layer is provided with at least a protective coating. This inventive method enables a coaxial cable to be manufactured rapidly and efficiently, and the outer conductor of the cable comprises an electroconductive lacquer. Application rates of tens of meters per minute can be realized without any problem. The solution preferably comprises a lacquer which contains electroconductive metal particles, such as copper and silver, in a polymeric matrix.

Preferably, a thin metal layer is subsequently applied to the electroconductive lacquer layer, for example by means of electroless deposition in a liquid or by passing the cable through a solder bath of tin/lead (tin-plating). This metal layer is preferably provided by means of electrodeposition. If necessary, one or more protective coatings are finally provided on the outer conductor thus formed. These coatings serve to strengthen the coaxial cable or to protect it against external influences.

The invention will now be explained in greater detail by means of exemplary embodiments and the drawing, in which

Figure 1:
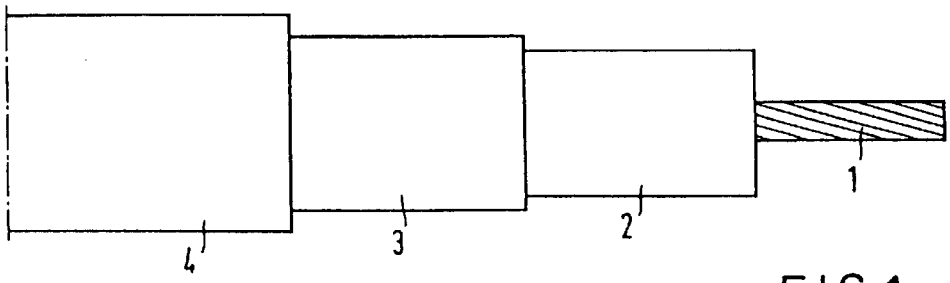
FIG. 1 shows a coaxial cable in accordance with the invention.

It is noted that the dimensions of the various parts shown in the drawing are not to scale.

FIG. 1 shows a coaxial cable. This cable comprises a central conductor 1, an electrically insulating layer 2, an outer conductor 3 and a protective coating 4.

DETAILED DESCRIPTION

In the present case, the central conductor 1 was composed of a steel wire which was circular in section and the surface of which was provided with a thin copper layer. The exact composition, configuration and thickness of this conductor are not essential features of the invention. The thickness of the central conductor customarily ranges between 0.01 and 0.5 mm. In this case, the thickness was 0.2 mm.

A layer 2 of an electrically insulating material was provided around the central conductor. In this case the layer thickness was 0.5 mm. The desired thickness of this layer depends on the dielectric value of the electrically insulating material used. The thickness customarily ranges between 0.01 and 0.8 mm. The layer can be made of a thermoplastic synthetic resin provided on the central conductor by means of extrusion. Well-known synthetic resins which can be used for this purpose are foamed or non-foamed polyethylene and/or polypropylene. In this case, the layer was a bi-layer of FEP and polyethylene. Other materials which can suitably be used for this purpose are fluoropolymers, such as polytetrafluoroethylene (PTFE).

The outer conductor 3 of the inventive coaxial cable comprises a thin layer of an electroconductive lacquer. In this case, the lacquer consists of a suspension of metal particles of silver in a thermoplastic synthetic resin, such as polyester, polyurethane or polyacrylate. Lacquers comprising metal particles of copper or nickel can also suitably be used. By virtue of the presence of the synthetic resin matrix, such lacquers adhere well to an electrically insulating layer of a synthetic resin. In this case, the thickness of the outer conductor is 10 micrometers.

Preferably, the surface of layer 3 facing away from the central conductor is further provided with a thin metal layer, for example of Sn, Ni or Sn/Pb. For clarity, this layer is not shown in the Figure. The thickness of this metal layer typically ranges from 5 to 25 micrometers. By virtue of the presence of the metal particles in the electroconductive lacquer layer, a satisfactory adhesion between the metal layer and the lacquer layer is achieved.

The outer conductor 3 may optionally be provided with one or more protective coatings. Said coatings are generally made of a synthetic resin, such as polyethylene or polyurethane, PVC or a fluoropolymer, which can be provided by means of extrusion. The thickness of such a layer typically ranges from 50 to 500 micrometers. If necessary, the protective coating also comprises flame retardants. It is noted once more that this protective coating is not absolutely necessary.

Figure 2:
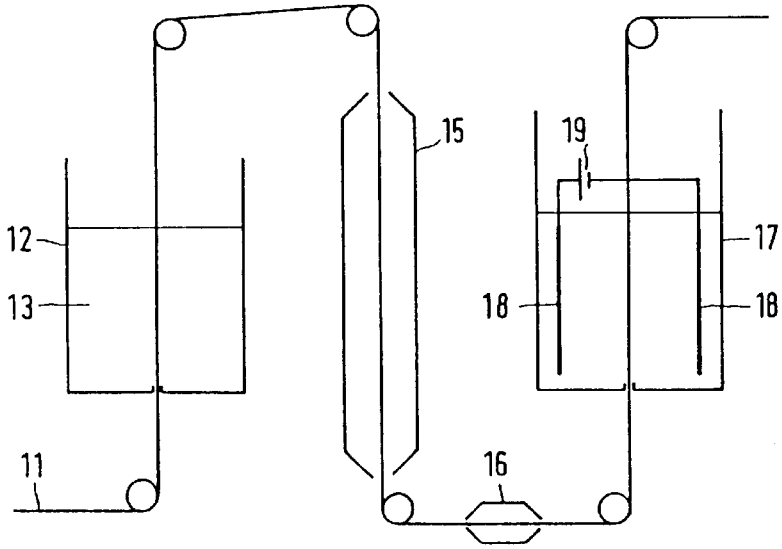
FIG. 2 schematically shows how the inventive cable can be manufactured.

FIG. 2 schematically shows how a coaxial cable in accordance with the invention can be manufactured. A cable 11 is composed of a central conductor which is provided with an electrically insulating layer. This cable is passed through a bath 12 containing a solution of an electroconductive lacquer. In the present case, the lacquer is Elektodag 1415, supplied by Acheson (see product data sheet attached hereto and incorporated herein by reference). This lacquer comprises Ag particles in a thermoplastic synthetic resin, dissolved in methyl ethyl ketone. The coaxial cable is passed through a furnace 15. In this furnace, the lacquer is cured at a temperature of approximately 125° C. If necessary, the thickness of the outer conductor can be increased by passing the wire a number times through the lacquer solution and the furnace.

In the case described herein, the lacquer layer is additionally provided with a thin metal layer by means of electrodeposition. To this end, the coaxial cable with the cured lacquer layer is first activated by subjecting it to a light etching treatment by means of ozone in an ozonizer 16. Subsequently, the cable thus etched is passed through a bath 17. This bath comprises a number of plates 18 of lead/tin which, via a current source 19, are brought to a negative potential relative to the outer conductor of the cable passed through the bath. As a result of this voltage difference, the plates slightly dissolve to form lead and tin salts in the water of the bath 17. These salts are subsequently reduced on the electroconductive lacquer layer of the cable, thereby forming a thin metal layer of lead/tin on said lacquer layer. The cable is subsequently passed through a rinsing bath (not shown) and dried. Finally, the cable is provided with an insulating sheath (not shown) by means of extrusion.

Figure 3:
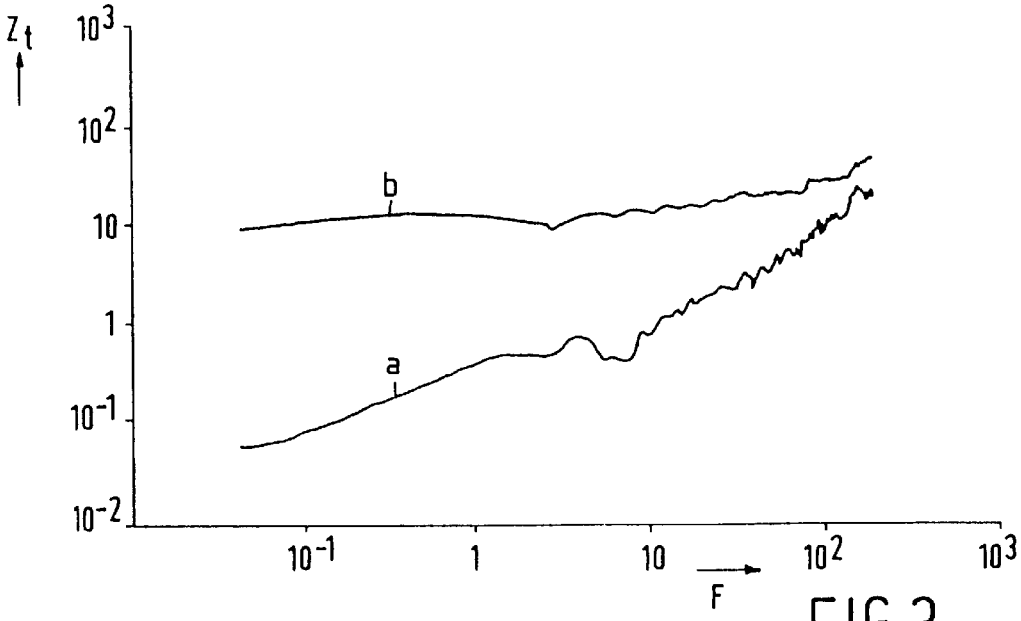
FIG. 3 is a graph showing the transfer impedance of two coaxial cables as a function of the frequency.

FIG. 3 is a graph showing the so-called transfer impedance z, (Ohm/m) as a function of the frequency F (MHz) of two coaxial cables. Curve a is measured on a known coaxial cable having a stranded outer conductor. Curve b is measured on an inventive coaxial cable having an outer conductor on the basis of an electroconductive lacquer. In either case, the thickness of the central conductor was 0.5 mm. The thickness of the insulating layer was 0.45 mm in either case. The known coaxial cable was provided with a stranded outer conductor having a thickness of 0.4 mm. The cable in accordance with the invention was provided with an outer conductor on the basis of an electroconductive lacquer layer having a thickness of 0.01 mm.

The graph shows that, in the case of the inventive cable, the frequency-dependence of the transfer impedance is much smaller than that of the known cable. This is an important advantage of the inventive coaxial cable.

What is claimed is:

1. A coaxial cable comprising:

a central conductor;

an outer conductor, said outer conductor being an electroconductive lacquer conductor;

an electrically insulating layer separating said central and said outer conductor; and said electroconductive lacquer conductor has a thin metal outer layer over it.

2. A coaxial cable as claimed in claim 1 further comprising a protective coating over said electroconductive lacquer conductor.

3. A method of manufacturing a coaxial cable comprising insulating a central conductor of said cable with an electrical insulating layer;

passinq said insulated central conductor through a solution of electroconductive lacquer so as to provide said cable with an outer conductor which is an electroconductive lacquer conductor;

drying said cable after it has been passed through said solution.

4. A method as claimed in claim 3, wherein the lacquer conductor comprises electroconductive particles of metal.

5. A method as claimed in claim 3 or 4, characterized in that a thin metal layer is applied to the lacquer conducter.

6. A method as claimed in claim 5, characterized in that the metal layer is provided by means of electrodeposition.

7. A coaxial cable as claimed in claim 5 further comprising the step of providing a protective coating over said electroconductive lacquer conductor.

8. A coaxial cable as claimed in claim 3 further comprising the step of providing a protective coating over said electroconductive lacquer conductor.

9. A coaxial cable comprising;

a central conductor;

an outer conductor, said outer conductor being an electroconductive lacquer conductor;

an electrically insulating layer separating said central and said outer conductor, and said lacquer conductor having electroconductive particles of metal and said electroconductive lacquer conductor has a thin metal layer over it.

10. A coaxial cable as claimed in claim 9 further comprising a protective coating over said electroconductive lacquer conductor.

11. A coaxial cable comprising;

a central conductor;

an outer conductor, said outer conductor being an electroconductive lacquer conductor;

an electrically insulating layer separating said central and said outer conductor, the thickness of the electroconductive lacquer conductor is less that 200 micrometers, and said electroconductive lacquer conductor has a thin metal outer layer over it.

12. A coaxial cable as claimed in claim 11 further comprising a protective coating over said electroconductive lacquer conductor.

* * * * *